US011594105B2

(12) United States Patent
Furlong

(10) Patent No.: US 11,594,105 B2
(45) **Date of Patent: *Feb. 28, 2023**

(54) SYSTEM AND METHOD FOR INTERACTIVE GAMES

(71) Applicant: Patrick Furlong, Lake Mary, FL (US)

(72) Inventor: Patrick Furlong, Lake Mary, FL (US)

( * ) Notice: Subject to any disclaimer, the term of this patent is extended or adjusted under 35 U.S.C. 154(b) by 100 days.

This patent is subject to a terminal disclaimer.

(21) Appl. No.: 17/329,337

(22) Filed: May 25, 2021

(65) Prior Publication Data

US 2021/0280014 A1 Sep. 9, 2021

Related U.S. Application Data

(66) Continuation of application No. 16/597,852, filed on Oct. 10, 2019, now Pat. No. 11,017,635, Substitute for application No. 62/744,466, filed on Oct. 11, 2018.

(51) Int. Cl.
*G07F 17/32* (2006.01)
*G07F 17/34* (2006.01)

(52) U.S. Cl.
CPC ..... *G07F 17/3262* (2013.01); *G07F 17/3213* (2013.01); *G07F 17/3234* (2013.01); *G07F 17/3267* (2013.01); *G07F 17/34* (2013.01); *G07F 17/323* (2013.01)

(58) Field of Classification Search
None
See application file for complete search history.

(56) References Cited

U.S. PATENT DOCUMENTS

| | | | | |
|---|---|---|---|---|
| 3,119,485 | A | 1/1964 | Bayers | |
| 5,402,872 | A | 4/1995 | Clurman | |
| 5,816,918 | A | 10/1998 | Kelly et al. | |
| 6,048,269 | A | 4/2000 | Burns et al. | |
| 6,190,254 | B1 | 2/2001 | Bennett | |
| 8,771,051 | B2 | 7/2014 | Mattice et al. | |
| 9,117,331 | B2 | 8/2015 | Engelman et al. | |
| 9,147,320 | B2 * | 9/2015 | McInerny | G07F 17/32 |
| 9,600,959 | B2 | 3/2017 | Lutnick et al. | |
| 10,482,709 | B2 * | 11/2019 | Walker | G07F 17/3267 |
| 11,482,078 | B2 * | 10/2022 | Sevigny | G07F 17/3258 |
| 2005/0116413 | A1 | 6/2005 | Wagner | |
| 2005/0187005 | A1 | 8/2005 | Rose | |
| 2006/0118581 | A1 | 6/2006 | Clark | |
| 2007/0026916 | A1 | 2/2007 | Juds et al. | |
| 2008/0020845 | A1 | 1/2008 | Low et al. | |
| 2015/0314192 | A1 | 11/2015 | Lettieri et al. | |
| 2017/0046906 | A1 * | 2/2017 | Hilbert | G07F 17/3225 |
| 2021/0280014 | A1 * | 9/2021 | Furlong | G07F 17/3234 |

* cited by examiner

*Primary Examiner* — Ronald Laneau
(74) *Attorney, Agent, or Firm* — Bold IP, PLLC; Chris Mayle

(57) ABSTRACT

A system and method for a drinking game, the method including providing a gaming machine having a series of digital or analog selection entities corresponding to various outcomes occurring within the game session such as possible types of alcohol, possible types of cordials, possible types of mixer, what type of drink, which player consumes the drink, and how the player consumes the drink, whereby a player pulls a lever and the selection entities land on a specific selection and the player consumes a drink based on the selection indicator after the stopping mechanism stops the selection entities.

20 Claims, 9 Drawing Sheets

165
300
101
300
203
101
600
101
SHOT SLOT
The original "Shot Machine"
Stop
Stop
Stop
Play
WIND
POOL
Coin Tray
Pick Up Prize
Pick Up Stage
LIVE
Payout Coin Slot
Coin Slot
Coin Slot

SYSTEM AND METHOD FOR INTERACTIVE GAMES

This application is a continuation of U.S. Non-provisional application Ser. No. 16/597,852 filed on Oct. 10, 2019, which claims priority to U.S. Provisional Application No. 62/744,466 filed on Oct. 11, 2018, which is incorporated by reference in its entirety.

FIELD OF THE DISCLOSURE

This disclosure relates generally to the field of gaming machines, and more particularly, to game for choosing a series of actions based on the outcome.

BACKGROUND

Games that provide useful information to players, while at the same time providing entertainment, have been popular for many years. In particular, games that encourage drinking alcoholic mixed drinks and shots that have a social entertainment component have become increasingly popular. These games can often combine known games and the drinking of alcohol to create new and entertaining drinking games.

Some examples of known drinking games include large circular wheels that a user must spin that are divided into sections that are pie shaped, wherein each section contains the name of a drink. These games often have a selector, where the game requires the user to drink the drink named in the section the stopper lands on. These games are very popular in bar settings because they provide entertainment value due to the randomness involved in the game.

However, problems with known drinking games and drinking game machines include that they are often too large for home use, only provide for the choice of pre-determined drink names, and do not provide for any opportunity for multiple outcomes.

Some games have tried to solve the problems in the prior art, such as U.S. Pat. No. 7,044,466, deals with a food preparation board game and a method of playing said game. The game involves a spin wheel having a pointer that a user will spin, and over the course of the game will randomly select recipe information and a plurality of ingredients. A player wins when they collect all of the ingredients required for a recipe.

However, the above patent fails to solve all of the problems in the prior art as it deals with food ingredients, only uses one spin wheel, and as a board game, it is not an ideal machine to be played on a bar or in a bar setting.

Due to all of the existing shortcoming in presently available devices, there is still a need for a drinking game machine that allows for random selection of drink ingredients, multiple outcomes, and a form factor suitable for a bar or home setting.

SUMMARY

The disclosure presented herein relates to a selection game comprising a gaming machine configured to randomly display a selection of a plurality of selections indicating which objects one or more players playing with the gaming machine will then interact with, the gaming machine including, an activator, and a plurality of selection reels having the plurality of selections whereby the activator when activated causes the plurality of selection reels to cycle through outcomes corresponding with a plurality of actions until an outcome of the outcomes is indicated by at least one outcome indicator when the plurality of selection reels stop cycling through the outcomes, whereby activation of the activator, produces a specific outcome indicated by the at least one outcome indicator for the one or more players to interact with an object of the objects corresponding to the specific outcome indicated by the at least one outcome indicator, the selection game of further including: one or more tokens, the one or more tokens configured to be received though a payout slot on the gaming machine, the one or more tokens received if the one or more players win a jackpot whereby if the one or more players receive a certain combination of three selections in the selection reels a row, horizontally, or in some embodiments diagonally, the one or more players wins the jackpot, the gaming machine further including: one or more LED lights configured to flash periodically or emit a continuous light when there is a change in status or an event occurs during the selection game, the gaming machine further including: a printer for printing redemption slips having identifying markers, an alarm, the alarm having a speaker allowing the one or more players to receive audible messages from the gaming machine, one or more cameras, the plurality of selection reels including one or more databases coupled via a network, one or more processors coupled to the one or more databases, at least one computing device coupled to the one or more processors and the one or more databases via the network, whereby the one or more processors are configured to receiving, by selection game, an order over the network initiated by the gaming machine, the order created in response to the specific outcome, whereby the one or more processors are further configured to: sending, by the selection game, a notification to the one or more players, the notification indicating one or more events occurring within the selection game, the gaming machine connected to a dispensing device, whereby the dispensing device dispenses the object corresponding to the specific outcome.

The embodiments of the present invention are also directed to a selection game including a gaming machine, configured to randomly display a selection of a plurality of selections indicating which sex position one or more players playing with the gaming machine will then need to perform, where the one or more players playing with the gaming machine will perform a sexual act and what prop the one or more players playing with the gaming machine will need to use, the gaming machine including, an activator, a plurality of selection reels having the plurality of selections whereby the activator when activated causes the plurality of selection reels to cycle through outcomes corresponding the plurality of selections until an outcome of the outcomes is indicated by at least one outcome indicator when the plurality of selection reels stop cycling through the outcomes, whereby activation of the activator, produces a specific outcome indicated by the at least one outcome indicator for the one or more players to perform the sexual act corresponding to the specific outcome indicated by the at least one outcome indicator in a location corresponding to the specific outcome indicated by the at least one outcome indicator with the prop corresponding the specific outcome indicated the at least one outcome indicator, the selection game further including one or more databases coupled via a network, one or more processors coupled to the one or more databases, one or more computing devices coupled to the one or more processors and the one or more databases via the network, whereby the one or more processors are configured to: receiving, by the selection game, an order over the network initiated by the gaming machine, the order created in response to the plurality of selections of the plurality of selection reels indicated by he at least one outcome indicator after a stopping mechanism stops the plurality of selection reels, sending, by the selection game, a notification to the one or more players, the notification indicating one or more events occurring within the selection game, the selection game, further including: one or more tokens, the one or more tokens configured to be transferred though a payout slot on the gaming machine, the one or more tokens transferred if the one or more players win a jackpot whereby if the one or more players select a certain combination of three selections in the plurality of selection reels a row, horizontally, or in some embodiments diagonally, the one or more players wins the jackpot, the gaming machine further including: one or more LED lights configured to flash periodically or emit a continuous light when there is a change in status or an event occurs during a selection game, an alarm, the alarm having a speaker allowing one or more players to receive an auditory signal audible messages from the gaming machine, the gaming machine connected to a dispensing device, whereby the dispensing device dispenses the prop, the gaming machine further including a dare coin whereby if the gaming machine dispenses the dare coin, the one or more players must complete the dare before playing again.

The preceding and following embodiments and descriptions are for illustrative purposes only and are not intended to limit the scope of this disclosure. Other aspects and advantages of this disclosure will become apparent from the following detailed description.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure. Also, the drawings included herein are considered by the applicant to be informal.

DETAILED DESCRIPTION

Figure 1:
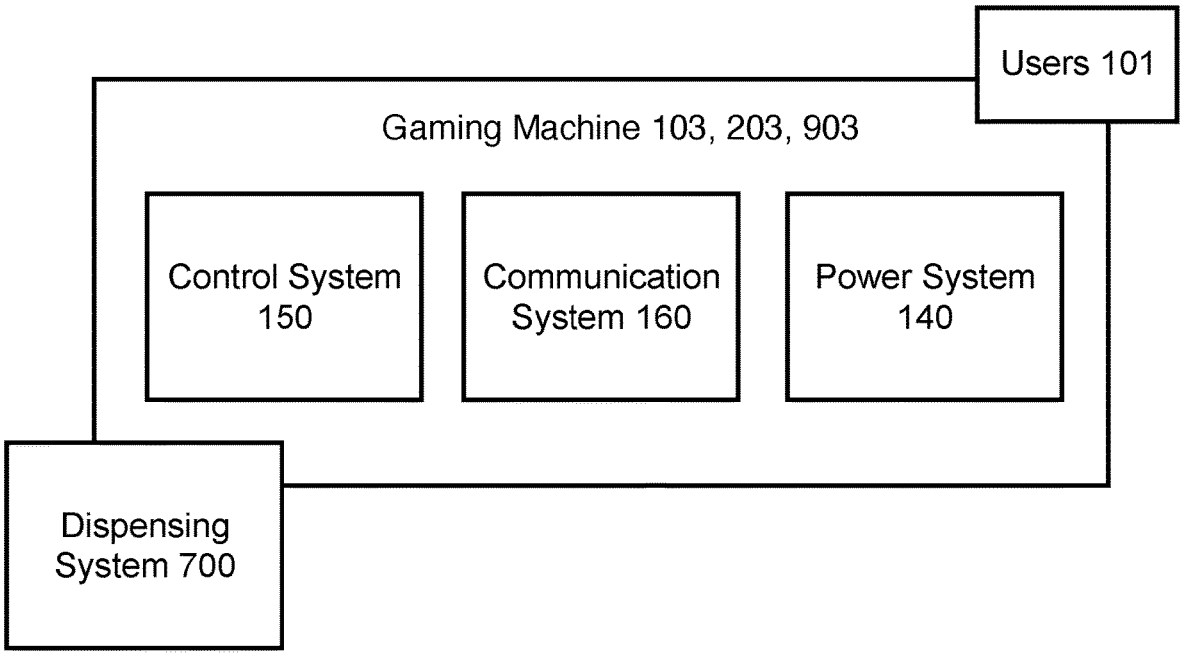
FIG. 1 is a block diagram illustrating the subsystems of the drink ingredient selecting game machine according to various aspects of the present disclosure.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and upper limit is the second number. For example, 25 to 100 mm means a range whose lower limit is 25 mm and upper limit is 100 mm.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The present description includes one or more embodiments for various drinking games and game machines that may be used to select ingredients for a drink as well as select a specific user who will consume the drink and how they will consume the drink. In one or more embodiments, an included gaming machine used in a drinking game may include multiple reels used to select ingredients to be used in a drink, such as the drink's booze, cordial, and mixer. For example, the gamine machine may include a booze selection reel, a cordial selection reel, and a mixer selection reel. In one or more embodiments, an included gaming machine used in a drinking game may include multiple reels used to select the drink, the user to consume the drink, and the method of consumption. For example, the gamine machine may include a who selection reel, a how selection reel, and a what selection reel.

Elements included herein are meant to be illustrative, rather than restrictive. Persons having ordinary skill in the art relevant to the present disclosure may understand there to be equivalent elements that may be substituted with the present disclosure without changing the essential function or operation of the machine and game.

Turning to FIG. 1, a block diagram of drink selecting game machine (henceforth the 'game machine') 103 and 203 according to various aspects of the present disclosure. In one or more embodiments, game machine 103 and 203 may be used as part of a drink selection game to help users or players such as users 101 select a booze, cordial, mixer, or other drink ingredients to be used in a drinking game. Game machine may be an actual physical device or a software application.

Gaming machine 103 may have a power system such as power system 140 that provides the energy to Gaming machine 103, including components such as the selection reel mechanisms, payment processing mechanisms, lights and sounds of gaming machine 103, communication systems such as communication systems 160, and control systems such as control system 150. Gaming machine 103 may be powered by methods known by those of ordinary skill in the art. In some embodiments, Gaming machine 103 may plug into an electrical outlet using an electrical cord to supply power to selection reel mechanisms, payment processing mechanisms, lights and sounds of gaming machine 103, communication system 160, and control system 150. Gaming machine 103 may include a rechargeable battery pack whereby the rechargeable battery is of a charge, design, and capacity, to provide sufficient power to selection reel mechanisms, payment processing mechanisms, lights and sounds of gaming machine 103, communication system 160, and control system 150 while operating the game machine for a set period of time.

Control system 150 may operate to control the actuation of the other systems. Control system 150 may have a series of computing devices which will be discussed in detail later in the description. Control system 150 may be in the form of, a circuit board, a memory or other non-transient storage medium in which computer-readable coded instructions are stored and one or more processors configured to execute the instructions stored in the memory. Control system 150 may have a wireless transmitter, a wireless receiver, and a related computer process executing the one or more processors.

Computing devices of control system 150, may be any type of computing device that typically operates under the control of one or more operating systems which control scheduling of tasks and access to system resources. Computing devices may be any computing devices such as but not limited to a phone, tablet, television, desktop computer, laptop computer, gaming system, wearable device electronic glasses, networked router, networked switch, networked, bridge, or any computing device capable of executing instructions with sufficient processor power and memory capacity to perform operations of control system 150.

The one or more computing devices may be integrated into control system 150, while in other non-limiting embodiments, control system 150 may be a remotely located computing device or server configured to communicate with one or more other control systems 150. Control system 150 may also include an internet connection, network connection, and/or other wired or wireless means of communication (e.g., LAN, etc.) to interact with other components. The connection allows users 101 to update, control, send/retrieve information, monitor or otherwise interact passively or actively with control system 150.

Control system 150 may include control circuitry and one or more microprocessors or controllers acting as a servo control mechanism capable of receiving input from the selection reel mechanism, payment processing systems, and communication system 160, analyzing the input from the selection reel mechanism, payment processing systems, and communication system 160, and generating an output signal from the selection reel mechanism, payment processing systems, and communication system 150. The microprocessors (not shown) may have on-board memory to control the power that is applied to the selection reel mechanism, payment processing systems, and communication system in response to input signals from the user and from other systems Control system 150 may be preprogrammed with any references values, by any combination hardwiring, software, firmware to implement various operational modes values. The microprocessors in control system 150 may also monitor the current state of circuitry within control system 150 to determine the specific mode of operation chosen by the user. Further, such microprocessors that may be part of control system 150 may receive signals from the selection reel mechanism and payment processing systems, such as whether any of the components in the various systems need to be replaced.

In some embodiments, gaming machines 103 and 203 may be connected to a drink dispensing system such as dispensing system 700. Control system 150 may receive a drink selection from a selection reel mechanism whereby control system 150 in response to the drink selection may retrieve, receive, or otherwise access information stored in databases of a server or databases of control system 150 or such as a recipes, formulations, and methods of making the drink selection. Control system 150 may then send a transmission to drink dispensing system 700 to dispense a drink via a nozzle of the drink dispensing system based on the drink selection from the selection reel mechanism. One such type of dispensing system, which permits an example of the apparatus, processes, methods, and systems potentially disclosed in U.S. Pat. No. 8,744,618, to Peters, et al., and U.S. Pat. No. 8,340,815, to Peters, et al., which are incorporated in their entirety by reference herein.

Figure 2:
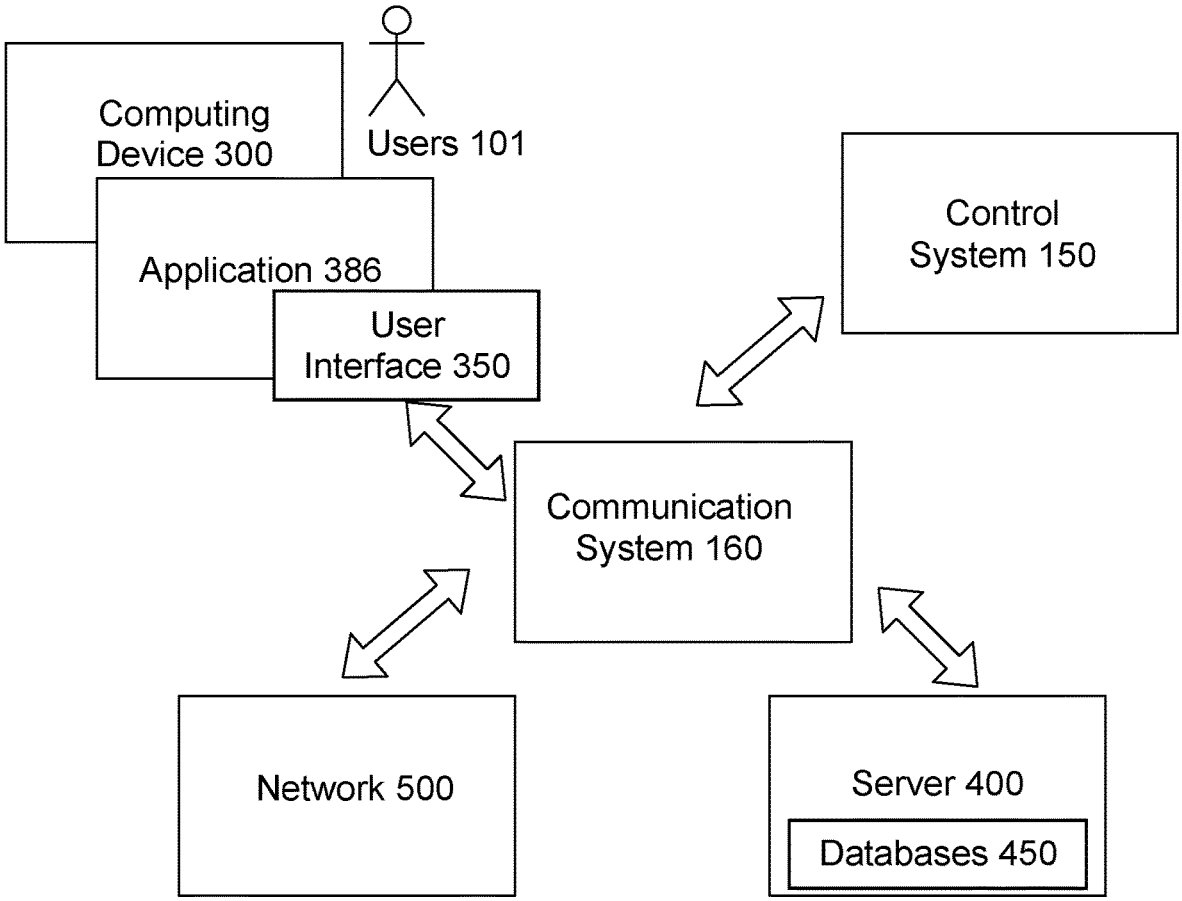
FIG. 2 is a block diagram of a system utilizing a drink ingredient selecting game machine according to various aspects of the present disclosure.

Control system 150 may be in communication with communication system 160, as illustrated in FIG. 2 to connect with other or computing devices whereby signals transmitted from the computing devices may be received by control system 150. Communication system 160 may allow users 101 to interact with control system 150 of gaming machine 103 using a computing device such as computing devices 300 even if users 101 are not proximate to control system 150. Users 101 may access a user interface, such as user interface 350 on an application or API such as drinking game application 386 using computing devices 300. User interface 350 may have a plurality of buttons or icons that are selectable by users 101 for communication system 160 to perform particular processes in response to the selections. In one or more non-limiting embodiments, communication system 160 may be innate, built into, or otherwise integrated into existing platforms or systems such as a website, a third party program, Apple™ operating systems (e.g. iOS), Android™, Snapchat™, Instagram™, Facebook™, or any other platform.

Computing devices 300 of communication system 160 may be similar to the computing devices of control system 150 and may be any type of computing device that typically operates under the control of one or more operating systems, which control scheduling of tasks and access to system resources. Computing devices 300 may in some embodiments be a computing device such as an iPhone™, Android-based phone, or Windows-based phone, a tablet, television, desktop computer, laptop computer, gaming system, wearable device electronic glasses, networked router, networked switch, networked, bridge, or any computing device capable of executing instructions with sufficient processor power and memory capacity to perform operations while in communication with network. Computing devices 300 may have location tracking capabilities such as Mobile Location Determination System (MLDS) or Global Positioning System (GPS) whereby they may include one or more satellite radios capable of determining the geographical location of computing devices 300.

In some embodiments computing devices 300 may be in communication with one or more servers such as server 400 via communication system 160 or one or more networks such as network 500 connected to communication system 160. Server 400 may be located at a data center, or any other location suitable for providing service to network 500 whereby server 400 may be in one central location or in many different locations in multiple arrangements. Server 400 may comprise a database server such as MySQL® or Maria DB® server. Server 400 may have an attached data storage system storing software applications and data. Server 400 may have a number of modules that provide various functions related to communication system 160. Modules may be in the form of software or computer programs that interact with the operating system of server 400 whereby data collected in databases such as databases 450 serve as instruction-based expressions of components and/or processes under communication system 160 and may be processed by one or more processors within server 400 or another component of communication system 160 as well as in conjunction with execution of one or more other computer programs.

Modules may be configured to receive commands or requests from computing devices 300, server 400, and outside connected devices over network 500. Server 400 may comprise components, subsystems, and modules to support one or more management services for communication system 160. For example, server 400 may include a chat module operative to maintain presence information for one or more users 101 and to provide chat functionality allowing users 101 to communicate messages in a chat through communication system 160.

In one or more non-limiting embodiments, network 500 may include a local area network (LAN), such as a company Intranet, a metropolitan area network (MAN), or a wide area network (WAN), such as the Internet or World Wide Web. Network 500 may be a private network or a public network, or a combination thereof. Network 500 may be any type of network known in the art, including telecommunications network, a wireless network (including Wi-Fi), and a wireline network. Network 500 may include mobile telephone networks utilizing any protocol or protocols used to communicate among mobile digital computing devices (e.g. computing device 300), such as GSM, GPRS, UMTS, AMPS, TDMA, or CDMA. In one or more non-limiting embodiments, different type of data may be transmitted via network 500 via different protocols. In alternative embodiments, user computing devices 300, may act as standalone devices or whereby they may operate as peer machine in a peer-to-peer (or distributed) network environment.

Network 500 may further include a system of terminals, gateways, and routers. Network 500 may employ one or more cellular access technologies including 2nd (2G), 3rd (3G), 4th (4G), 5th (5G), LTE, Global System for Mobil communication (GSM), General Packet Radio Services (GPRS), Enhanced Data GSM Environment (EDGE), and other access technologies that may provide for broader coverage between computing devices 300, for instance when they are in a remote location not accessible by other networks.

Figure 3:
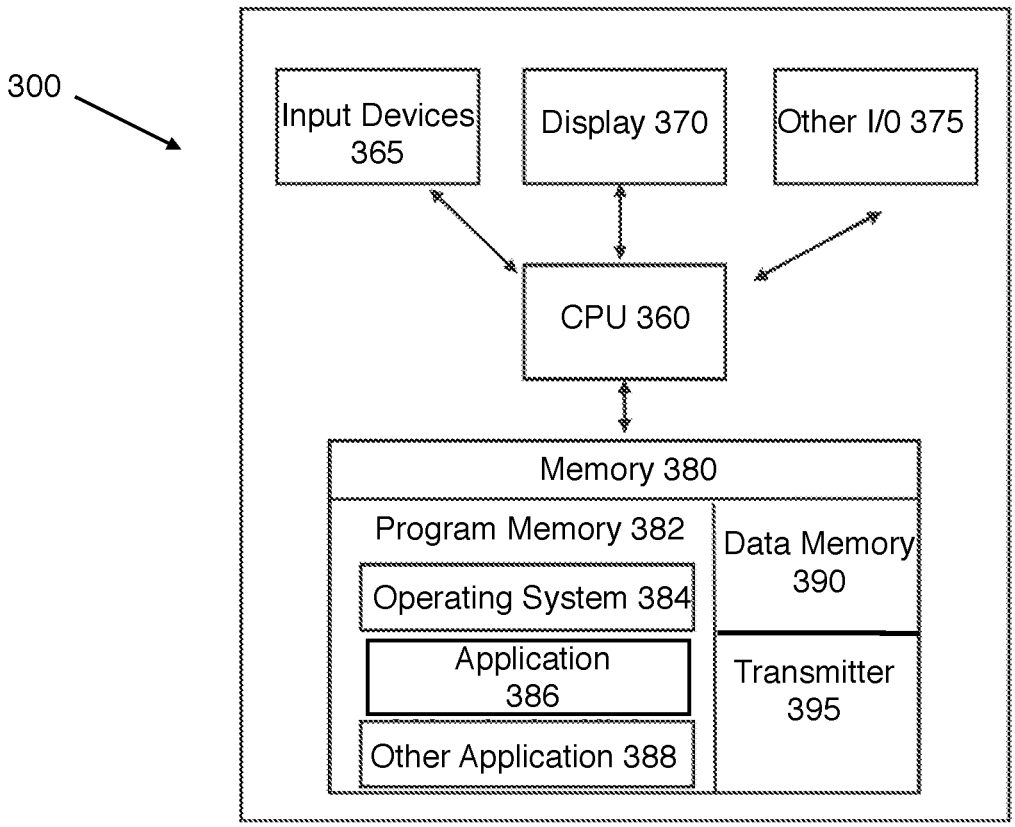
FIG. 3 is a block diagram of computing device according to various aspects of the present disclosure.

Turning to FIG. 3, FIG. 3 is a block diagram showing various components of computing devices 300. Computing devices 300 may comprise a housing for containing one or more hardware components that allow access to edit and query communication system 160. User Computing devices 300 may include one or more input devices such as input devices 365 that provide input to a CPU (processor) such as CPU 360 of actions related to user 101. Input devices 365 may be implemented as a keyboard, a touchscreen, a mouse, via voice activation, wearable input device, a camera a trackball, a microphone, a fingerprint reader, an infrared port, a controller, a remote control, a fax machine, and combinations thereof.

The actions may be initiated by a hardware controller that interprets the signals received from input device 365 and communicates the information to CPU 360 using a communication protocol. CPU 360 may be a single processing unit or multiple processing units in a device or distributed across multiple devices. CPU 360 may be coupled to other hardware devices, such as one or more memory devices with the use of a bus, such as a PCI bus or SCSI bus. CPU 360 may communicate with a hardware controller for devices, such as for a display 370. Display 370 may be used to display text and graphics. In some examples, display 370 provides graphical and textual visual feedback to a user.

In one or more embodiments, display 370 may include an input device 365 as part of display 370, such as when input device 365 is a touchscreen or is equipped with an eye direction monitoring system. In some implementations, display 370 is separate from input device 365. Examples of display 370 include but are not limited to: an LCD display screen, an LED display screen, a projected, holographic, virtual reality display, or augmented reality display (such as a heads-up display device or a head-mounted device), wearable device electronic glasses, contact lenses capable of computer-generated sensory input and displaying data, and so on. Display 370 may also comprise a touch screen interface operable to detect and receive touch input such as a tap or a swiping gesture. Other I/O devices such as other I/O devices 375 may also be coupled to the processor, such as a network card, video card, audio card, USB, FireWire or other external device, camera, printer, speakers, CD-ROM drive, DVD drive, disk drive, or Blu-Ray device. In further non-limiting embodiments, a display may be used as an output device, such as, but not limited to, a computer monitor, a speaker, a television, a smart phone, a fax machine, a printer, or combinations thereof.

CPU 360 may have access to a memory such as memory 380. Memory 380 may include one or more of various hardware devices for volatile and non-volatile storage and may include both read-only and writable memory. For example, memory 380 may comprise random access memory (RAM), CPU registers, read-only memory (ROM), and writable non-volatile memory, such as flash memory, hard drives, floppy disks, CDs, DVDs, magnetic storage devices, tape drives, device buffers, and so forth. Memory 380 may be a non-transitory memory.

Memory 380 may include program memory such as program memory 382 capable of storing programs and software, including an operating system, such as operating system 384. Memory 380 may further include a drinking game application, such as drinking game application 386, and other computerized programs or application programs such as other application programs 388. Memory 380 may also include data memory such as data memory 390 that may include database query results, configuration data, settings, user options, user preferences, or other types of data, which may be provided to program memory 382 or any element of user computing devices 300.

Computing devices 300 may have a transmitter, such as transmitter 395, to transmit data. Transmitter 395 may have a wired or wireless connection and may comprise a multi-band cellular transmitter to connect to the server 400 over 2G/3G/4G cellular networks. Other embodiments may also utilize Near Field Communication (NFC), Bluetooth, or another method to communicate information.

Figure 4:
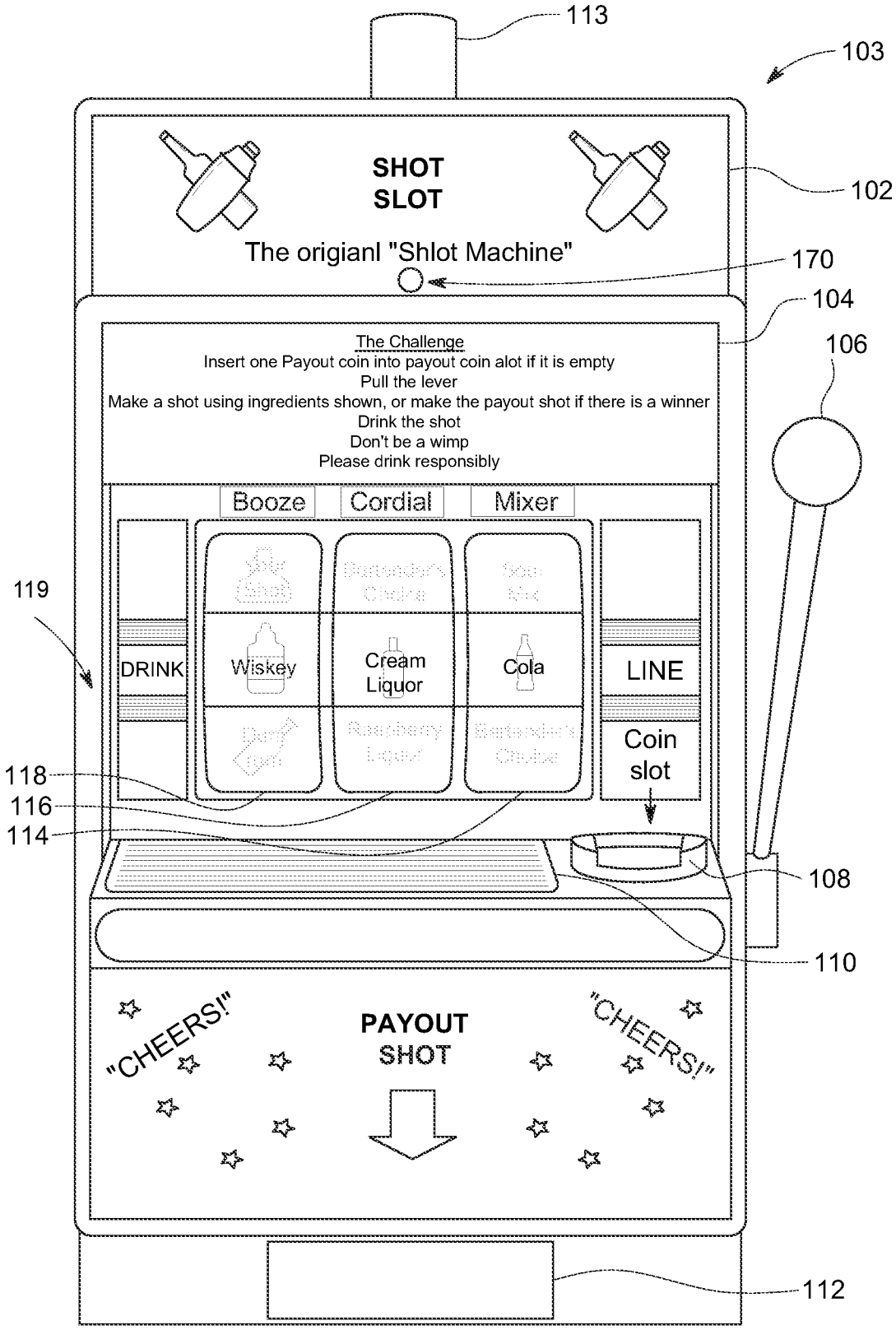
FIG. 4 is a front view of an embodiment of a drink ingredient selecting game machine according to various aspects of the present disclosure.

Turning to FIG. 4, a front view of drink ingredient selecting game machine (henceforth the 'game machine') 103 according to various aspects of the present disclosure is illustrated. In one or more embodiments, game machine 103 may be used as part of a game ingredient selection game to help a player select a booze, cordial, mixer, or other drink ingredients to be used in a drinking game.

In one or more embodiments, game machine 103 may include a game banner such as game banner 102, an alarm such as alarm 113, a set of instructions such as set of instructions 104, a lever such as lever 106, a payment interface such as payment interface 108, a tray such as tray 110, a payout slot such as payout slot 112, a booze selection reel such as booze selection reel 118, a cordial selection reel such as cordial selection reel 116, and a mixer selection reel such as mixer selection reel 114. In other non-limiting embodiments lever 106 may be any activator such as a button, pulling mechanism, and/or audio or visual commands.

Game machine 103, in some embodiments, includes game banner 102 on the surface of game machine 103. Game banner notifies the user the name of the game and can include company name and brand name of the machine to help distinguish game machine 103 from other game machines. Below game banner 102, in one or more embodiments, may be a set of instructions 104. Set of instructions 104 may include the rules for playing the drink ingredient selection game. For example, in the FIG. 4 embodiment, set of instructions 104 may include inserting a "payout coin" into the payment slot 108 (referred to also as payment interface 108), pulling lever 106, making a drink shot using the ingredients shown on the selection reels (discussed below), and drinking the shot. In this embodiment, the payout coin is an artificial coin, digital currency, or other token used to activate gaming machine 103. In a home consumer version of game machine 103, an artificial coin to activate the machine is preferable, as the game is meant for home entertainment. In a bar setting, some embodiments of game machine 103 may require a token, real money, or fake money to activate and allow users 101 to play the game.

In use, a user 101 would play a drink ingredient selection game using game machine 103 by first activating the machine by inserting payment into the payment slot 108. In some embodiments, the payment slot may include a credit card reader or a coin reader whereby the price may be set by the owner of the machine or establishment in a bar or commercial setting. If game machine 103, in another embodiment, is privately owned, game machine 103 may be set up to not accept payment but be free to play and require no payment. In this embodiment, the machine is activated not by payment, but by pressing an activation button or by accepting artificial money coins included with game machine 103.

User 101 may input their credit card or debit card information for a credit card or debit card using any card known in the art, including, without limitation an ATM card, a VISA®, MasterCard®, Discover®, or American Express® card into credit card ready, or can alternatively use Apple Pay® or another system known by those of ordinary skill in the art. Once the transaction has been approved by the third-party payment facilitator, funds are deducted from the personal account of user 101 and added to the account associated with gaming machine. If there are insufficient funds, a rejection may occur whereby the rejection transaction is logged and users 101 may be presented with the rejection notice through gaming machine whereby they may attempt another transaction.

Payment slot 108 may have optical bar code, a QR code, or a RFID tag reader connected to control system 150 for receiving data pertaining to drinking game process and storing the data in the databases of the memory of control system 150. Users 101 may also initiate a game scanning a code such as an optical bar code, a QR code, a RFID tag, or other suitable identification which can be received by payment slot 108 and transmitted to control system 150.

Payment slot 108 of gaming machine 103 may also include or otherwise operate a printer for printing cash out or redemption slips having codes or identifying markers as well as other information such as the current time and date on a permanent storage medium, such as paper, which is stored within the housing of gaming machine 103. In some cases, slips may not have coupons not having money values associated with them, but other forms of play are possible such as permitting users 101 to compete in a contest for the best drink or method of play in an establishment wide tournament. The printer prints a code on the slips responsive to the instructions from control system 150. Control system 150 generates the code to be printed. The code may represent the monetary value of the value of the credit stored in the particular gaming machine 103 along with a randomly generated number in order to permit control system 150 to verify the validity and unique identification of slip at a later time such as when read by optical bar code, a QR code, or a RFID tag reader connected to control system 150. Because control system 150 has randomly generated the unique identification, a cash out or redemption ticket may receive credit only once. If a code is invalid or already used, control system 150 may determine the code is void and will reject the slip.

Gaming machine may be connected to a POS system having various devices such as weighing scales, barcode scanners, and cash registers. A point of sale (POS) system as the term is used herein or point of purchase (POP) includes time and place a transaction is completed. To make a payment easier, payment terminals, touch screens, and other hardware and software options may be connected to gaming machine. POS terminal software may also include features for additional functionality, such as inventory management, customer relationship management (CRM), financials, or warehousing.

After the machine is activated, a user plays the drink selection drinking game by pulling lever 106. When pulled, lever 106 spins the drink ingredient selection reels 114, 116, and 118. In the FIG. 5 embodiment, drink ingredient selection reels 114, 116, and 118 stop automatically, either all three at once or one selection reel at a time to make the game more suspenseful. A reel stopping mechanism may be used to stop the selection reels. In some embodiments, the selection reels and the stopping mechanism are mechanical with glass or plastic cover. In another embodiment, the selection reels and stopping mechanism are digital, and the selection reels are a digital image on a screen whereby the selections not selected may be presented as blurrier than the selections. In this embodiment, the stopping mechanism is one or more computing devices 300 that determines the outcome of the game session.

In the FIG. 4 embodiment, three selection reels may be used such as a booze selection reel 118, a cordial selection real 116, and a mixer selection reel 114. In another embodiment, additional or different selections reels may be used for selection of different ingredients commonly found in drinks. Booze selection reel 118, as shown in the FIG. 2 embodiment, is a circular reel encoded with symbols representing different types of booze, or alcohols around its circumference. As shown in the FIG. 2 in a non-limiting embodiment, the words "dark rum" and "whiskey" are overlaid bottle silhouettes. Also shown in this embodiment, is a "your choice" symbol on selection reel meaning if the reel stopped on this selection, a user would be able to choose what kind of booze they want in their drink. In another embodiment, a booze selection is not included, and a non-alcoholic or other drink ingredient reel is used.

Cordial selection reel 116 is also shown in this figure. A cordial (also known as a liqueur or schnapps) is an alcoholic beverage made from a distilled spirt flavored with either fruit, cream, herbs, spices, flower, or nuts and can be bottled with added sugars or other sweeteners, and are often added into shots, cocktails, and layered drinks to provide flavor. As shown in FIG. 4, cordial selection reel 116 may be a circular reel that is encoded with the names of different cordials around its circumference. In another embodiment, symbols, such as a silhouette of a bottle, can be used instead of words.

The third reel shown in the figure is mixer selection reel 114. A mixer is often a non-alcoholic drink ingredient used in a mixed drink, shots, and cocktails. They are used to change or enhance the flavor of the drink, and the FIG. 4 embodiment has a circular reel with cola and sour mix shown as examples of mixers. Any commonly used mixer in alcoholic beverages can be used. In the FIG. 4 embodiment, a circular reel with a mixture of words and symbols are encoded around the reels circumference is shown, but in other embodiments, any sort of encoding of a symbol or writing can be used. The FIG. 4 example also contains a "Bartender's Choice" symbol on the selection reel 114. In some embodiments, the bartender would have a choice of what mixer to use if this option was selected. In another embodiment, game machine 103 may contain other selections that act as random events, such as giving a third party the option to choose the booze, that do not fit in with the rest of the selections on their corresponding selection reels to add entertainment to the game.

In other embodiments, selection reels 114, 116, and 118 may be replaced with replacement reels. The replacement reel(s) includes multiple gaming symbols, which may have some, all, or no symbols in common with the symbols on the standard reels. The replacement reels in essence supersedes or otherwise replaces at least one of the gaming symbols of the standard reels. For example, the replacement reel may ultimately present a single symbol from its associated physical or virtual reel strip, or may ultimately present multiple symbols (e.g., the reel strip presenting three adjacent symbols). In some embodiments, a reel may have interchangeable faceplates that are magnets whereby the magnets may be positioned on the reel and then replaced such that selections may be changed. In other embodiments, reusable stickers may be attached to selection reels such that the selections may be changed. Replaceable reels, magnets, and reusable stickers may have identifying markers such as a QR code, a RFID tag, or other suitable identification technology whereby control system 150 may determine the corresponding selection and update databases 450.

Figure 5:
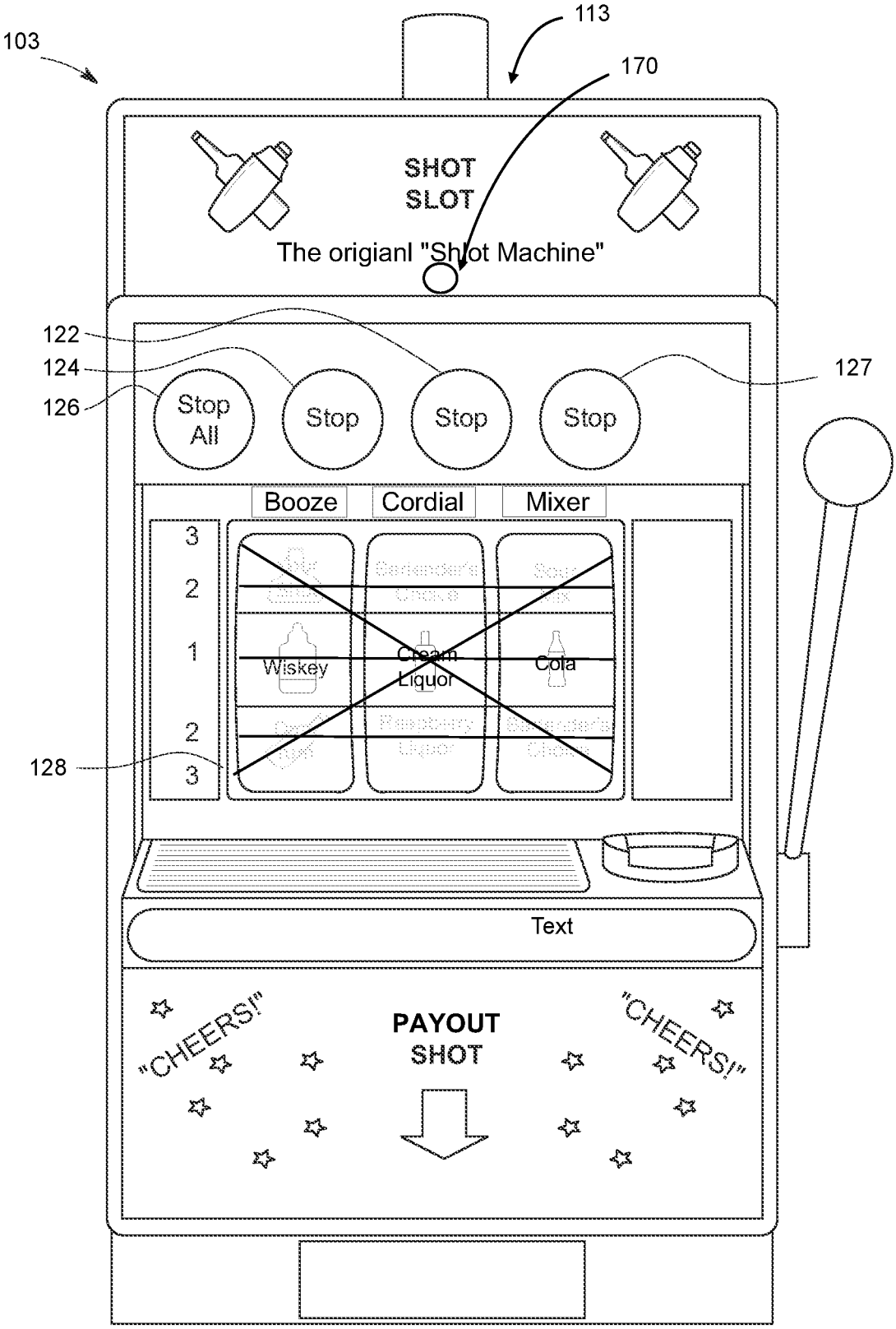
FIG. 5 is another front view of the first embodiment of the drink ingredient selecting game machine.

After the reel stopping mechanism has stopped the selection reels 114, 116, and 118 from spinning, in the FIG. 5 embodiment, the user must make a drink based off of the middle selection of each selection reel, as viewable by users 101, using the ingredients displayed on the selection reels. The selection indicator 119, in the FIG. 4 example, is the word "DRINK" next to the selection reels 114, 116, and 118. This visible indicator shows where on selection reels 114, 116, and 118 is the selected option. For example, in the FIG. 4 embodiment, if the FIG. 4 view was displayed after pulling lever 106 and selection reels 114, 116, and 118 had already stopped, users 101 would have to make a shot (or other mixed drink) using whiskey as the booze, cream liquor as the cordial, and cola as the mixer. The user would then have to drink the shot as dictated by the rules of the game.

In a non-limiting embodiment, one of selection reels 114, 116, and 118 may contain a jackpot selection, highlighted with the word "Jackpot" or some other symbol, such as "Free Drink," as determined before manufacturing of game machine 103 or after by the owner of the gaming machine whereby gaming machine may provide one or more controls for manually or digitally changing the jackpot. This may be customized over designated time periods chosen by the owner such as daily, weekly, or monthly, as well as for promotions or to move a product. If the user receives a certain combination of three of the symbols in a row, horizontally, or in some embodiments diagonally, the user wins a jackpot. In some embodiment, the jackpot dispenses one or more coins in payout slot 108. In this embodiment, the one or more coins can be traded to the bartender, operator of the machine, or game machine 103 owner for a prize such as a free drink or something else of monetary value. In another embodiment, payout slot 108 may dispense any other prize commonly found in slot machine payouts. In another embodiment, when a jackpot is won, or when a pre-determined order of reel selections is selected, game machine 103 may have a flashing alarm 113 that is sounded.

Gaming machine 103 may have one or more LED lights whereby LED lights notify user something has changed or an event is occurring with gaming machine 103, such as a user hitting a jackpot. LED lights may be a light emitting diode that flashes periodically or emits a continuous light when there is a change in the status or an event occurs.

Alarm 113 may have a connected speaker assembly that converts an electrical signal from control system 150 into an audible sound. The speaker assembly may be mounted to the housing of gaming machine 103 such that audible sound from the speaker has access to the exterior of the housing of gaming machine 103 where it then may be heard in the surrounding environment. The purpose of the speaker may be to allow users 101 or third party to receive an auditory signal audible messages from gaming machine 103 signifying a change in status or that an event has occurred within the game. In some embodiments, control system 150 may be connected to a microphone that allows for the passage of sound into control system 150 to receive auditory signals from a person in proximity. Control system 150 may also have the necessary circuitry to amplify and convert the signal to speaker and to convert the signal from microphone to control system 150. The speaker may add entertainment value of the game machine by making it more interactive by supplying feedback to users 101.

Gaming machine 103 may have one or more primary cameras such as primary camera 170 on housing of gaming machine 103 whereby primary camera 170 may have one or more lenses, one or more sensors, a photosensitive device, and one or more LED lights whereby images and video may be captured. For example, camera 170 may capture pictures or video from a 360 degrees field of view which may then be received by control system 150 and transmitted to communication system 160 for presentation via user interface 350. Camera 170 may utilize sensors such as a charged-coupled device (CCD) or Complementary Metal-Oxide Semiconductor (CMOS) to sense a captured scene. The sensors in the camera may capture light reflected from the scene taken and translate the strength of that light into a numeric reading by passing light through a number of different color filters whereby the readings are combined and evaluated via software to determine the specific color of each segment of the picture.

FIG. 5 is a front view of a drink ingredient selecting game machine 103 according to various aspects of the present disclosure. In this embodiment, a stop all button 126, booze selection reel stop button 124, cordial selection reel stop button 122, and mixer selection reel stop button 127 are present. Using the selection reel stop buttons, after a play starts spinning reels 114, 116, and 118 by pulling lever 106, users 101 can stop each individual reels 114, 116, and 118 by pushing the corresponding stop buttons 122, 124, and 127. These stop buttons 122, 124, and 127 each initiate the reel stopping mechanism for each corresponding selection reel 114, 116, and 118. This allows the user to have more control and try and use their timing and skill to try and stop the reels on a desirable selection. The stop all button 126, allows the user to stop all the selection reels 114, 116, and 118 at the same time.

Additionally, FIG. 5 shows selection indicators 128. In FIG. 4, the selection indicator was indicated by a word next to the selection reels. In the FIG. 5 example, selection indicator 128 are a series of lines going horizontal and diagonally. These selection indicators 128 allow for a variety of different drink selections and jackpot options whereby multiple combinations may be displayed for multiple "booze", "mixer", and "cordial" selections. Additionally, these lines allow users 101 to insert more money and play multiple lines and have multiple ways to win with flexible outcomes Advantageously, the present description provides one or more embodiments of various types of drink ingredient selection games. Each drink ingredient selection game depicted herein provides advantages that overcome shortcomings of other types of drink related games that are played conventionally. Further, the various embodiments shown in the figures and described herein accommodate different size game machines and may be used in various applications, including, but not limited, to home use or in a commercial bar setting. Thus, the various embodiments described in the present description include a number of novel and helpful components that provide enhanced securing devices to benefit a user.

Figure 6:
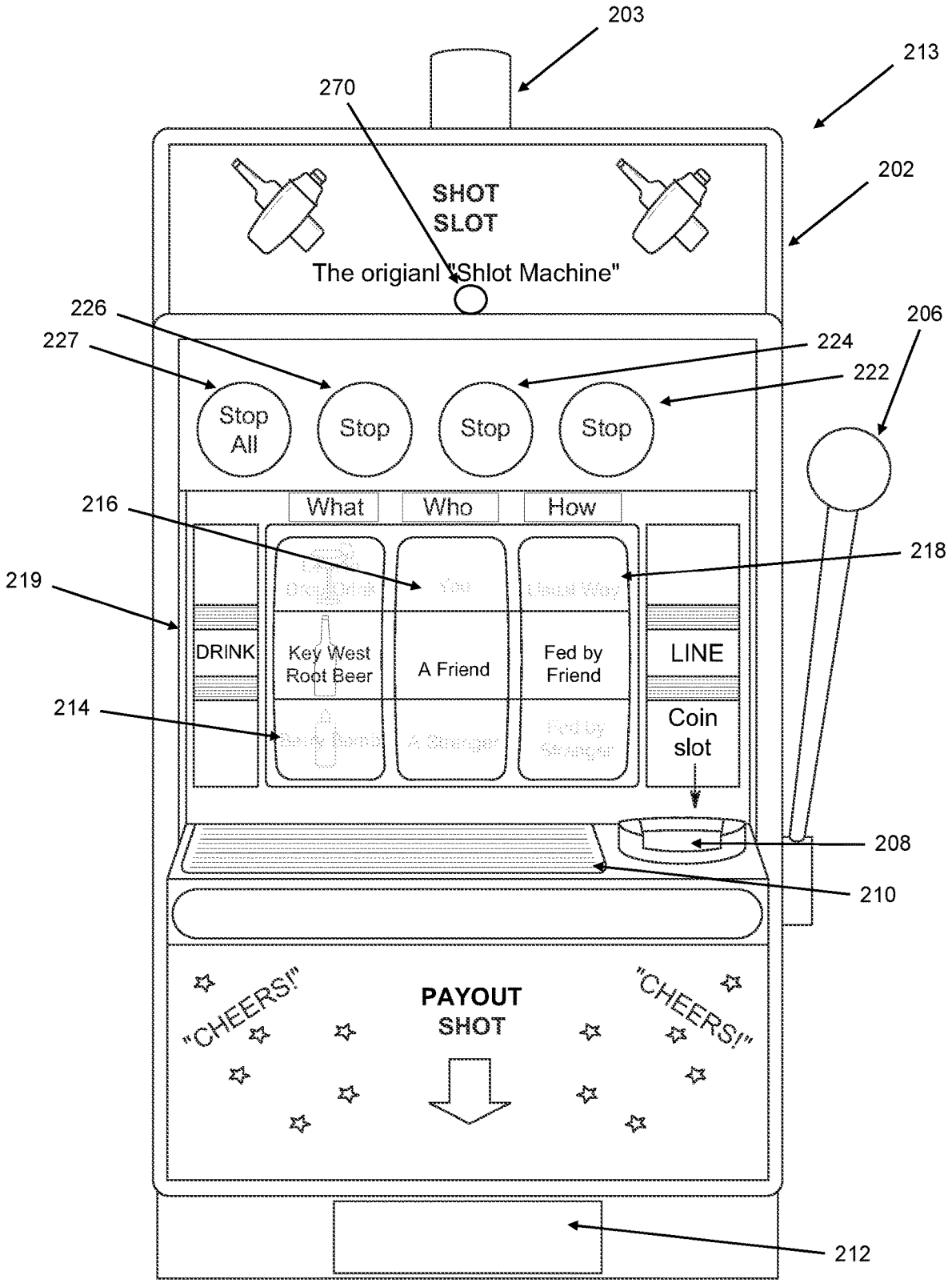
FIG. 6 is a front view of a second embodiment of the drink ingredient selecting game machine according to various aspects of the present disclosure.

Turning to FIG. 6, a front view of a second embodiment of drink selecting game machine (henceforth the 'game machine') 203 according to various aspects of the present disclosure is shown. In one or more embodiments, game machine 203 may be used as part of a drinking selection game to help users 101 select a drink or other object, who is consuming the drink or interacting with the object, and how they will be consuming the drink or interacting with the object. Game machine 203 operates in a similar manner to game machine 103 but has different rules with different possible outcomes. The main differences are the selection wheels, and the way the game is played. In the first embodiment, the selection wheels select the "booze," "cordial," and mixer that are used to create a drink. In the second embodiment, the selection wheels are changed to "the what," "the who," and "the how." Thus, the focus moves away from mixing the drink toward the game around the drinking of the beverage.

After the machine is activated, a user plays the drink selection drinking game by pulling lever 206. When pulled, lever 206 spins the drink selection reels 214, 216, and 218. In the FIG. 4 embodiment, the drink selection reels stop automatically, either all three at once or one selection reel at a time. A reel stopping mechanism is used to stop selection reels 214, 216, and 218. In some embodiments, the selection reels and the stopping mechanism are mechanical with glass or plastic cover. In another embodiment, the selection reels and stopping mechanism are digital, and the selection reels are a digital image on a screen whereby the selections not selected may be presented as blurrier than the selections. In this embodiment, the stopping mechanism is one or more computing devices 300 that determines the outcome of the game session.

In the FIG. 6 embodiment, three selection reels may be used such as a the "What" selection reel 214, the "Who" selection reel 216, and the "How" selection reel 218. In another embodiment, additional or different selections reels may be used for selection of different methods of playing a drinking selection game. "What" selection reel 214, as shown in the FIG. 6 embodiment, is a circular reel encoded with symbols representing different types of drinks around its circumference. This first wheel selects the drink to be consumed. This is a standard drink that most bartenders are used to making. This is attractive as it makes the life of the bartender easy. Some examples of standard drinks are lemon drop, key west root beer, berry bomb, etc.

As shown in FIG. 6 in a non-limiting embodiment, the words "Lemon Drop Drink", "Key West Root Beer", and "Berry Bomb" are overlaid bottle silhouettes. In some embodiments there may be a "your choice" symbol on selection reel 214 meaning if the reel stopped on this selection, a user would be able to choose what kind of booze they want in their drink. In another embodiment, an alcoholic drink selection is not included, and a non-alcoholic or other drink ingredient reel is used.

"Who" selection reel 216, as shown in the FIG. 6 embodiment, is a circular reel encoded with symbols representing different types of drinks around its circumference. The second wheel selects who should consume the drink. This adds to the game aspect as it introduces risk for possibilities beyond just the individual who purchased the drink. Some examples of the who wheel are yourself, a friend, a stranger, etc. As shown in FIG. 6, "Who" selection reel 216 may be a circular reel that is encoded with the names of different identifying names around its circumference. In another embodiment, symbols, such as a silhouette of a person may be used instead of words.

The third reel shown in the figure is the "How" selection reel 218. The third wheel selects the method in which the drink is to be consumed. This adds to the game aspect as it introduces an aspect of fun. Some examples of the how wheel are the usual way, fed by friend, fed by stranger, etc. In the FIG. 6 embodiment, a circular reel with a mixture of words and symbols are encoded around the reels circumference is shown, but in one embodiment, any sort of encoding of a symbol or writing can be used. In some embodiments there may be a "Bartender's Choice" symbol on the selection reel 218. In some embodiments, the bartender would have a choice how the drink should be consumed.

After the reel stopping mechanism has stopped the selection reels 214, 216, and 218 from spinning, in the FIG. 6 embodiment, a friend of a user of second selection reel 216 must make a drink based off of first selection reel 214 and consume it by the way described by third selection reel 218. The selection indicator 219, in the FIG. 6 example, is the word "DRINK" next to the selection reels 214, 216, and 218. This visible indicator shows where on selection reels 214, 216, and 218 is the selected option. For example, in the FIG. 6 embodiment, if the FIG. 76 view was displayed after pulling lever 206 and selection reels 214, 216, and 218 had already stopped, users 101 would have to make a shot (or other mixed drink). The user would then have to drink the shot as dictated by the rules of the game.

Gaming machine 203 may have one or more primary cameras such as primary camera 270 on housing of gaming machine 203 whereby primary camera 270 may have one or more lenses, one or more sensors, a photosensitive device, and one or more LED lights whereby images and video may be captured. For example, camera 270 may capture pictures or video from a 360 degrees field of view which may then be received by control system 150 and transmitted to communication system 160 for presentation via user interface 350. Camera 270 may utilize sensors such as a charged-coupled device (CCD) or Complementary Metal-Oxide Semiconductor (CMOS) to sense a captured scene. The sensors in the camera may capture light reflected from the scene taken and translate the strength of that light into a numeric reading by passing light through a number of different color filters whereby the readings are combined and evaluated via software to determine the specific color of each segment of the picture.

Figure 7:
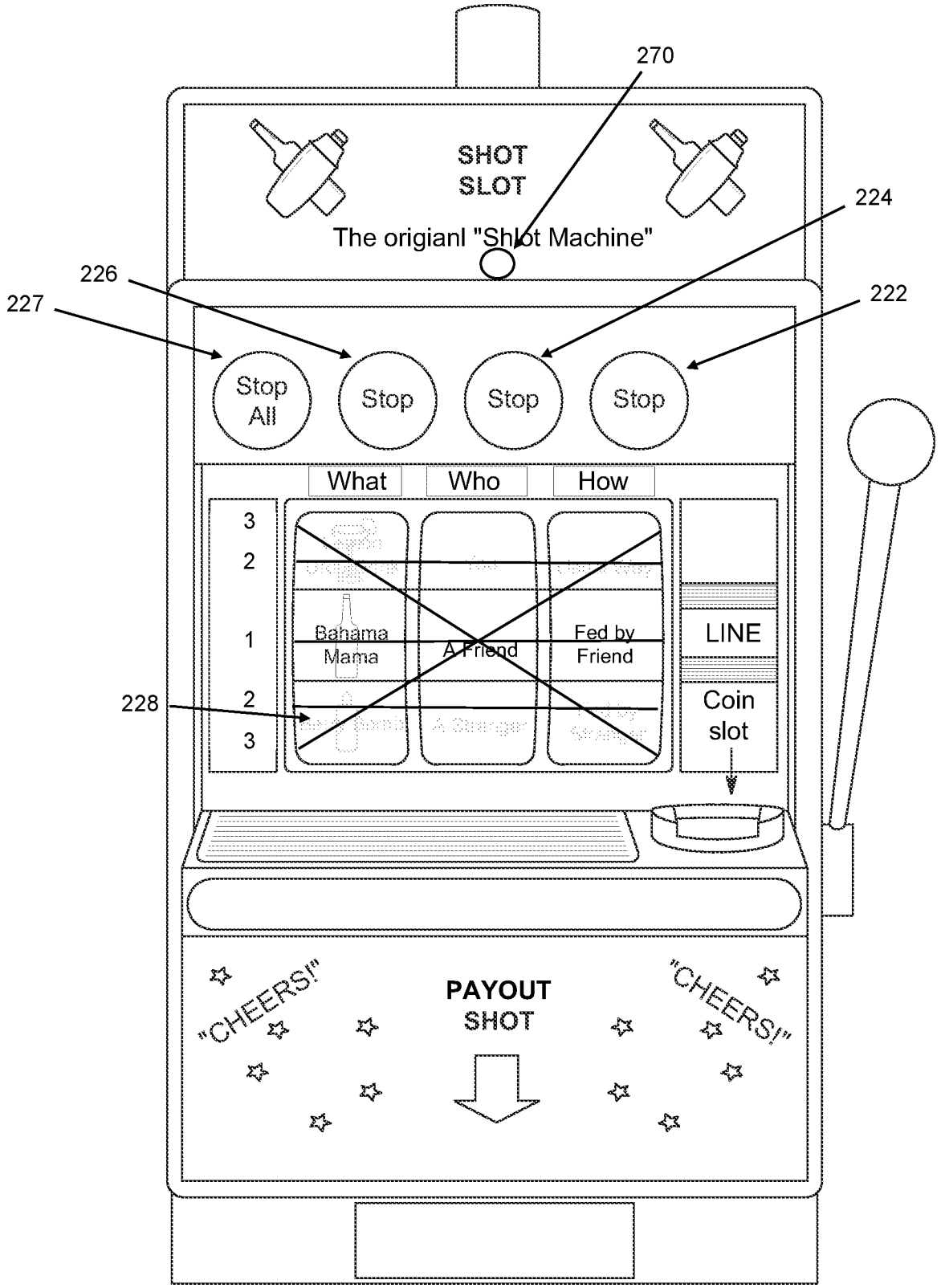
FIG. 7 is another front view of the second embodiment of the drink ingredient selecting game machine according to various aspects of the present disclosure.
Figure 8:
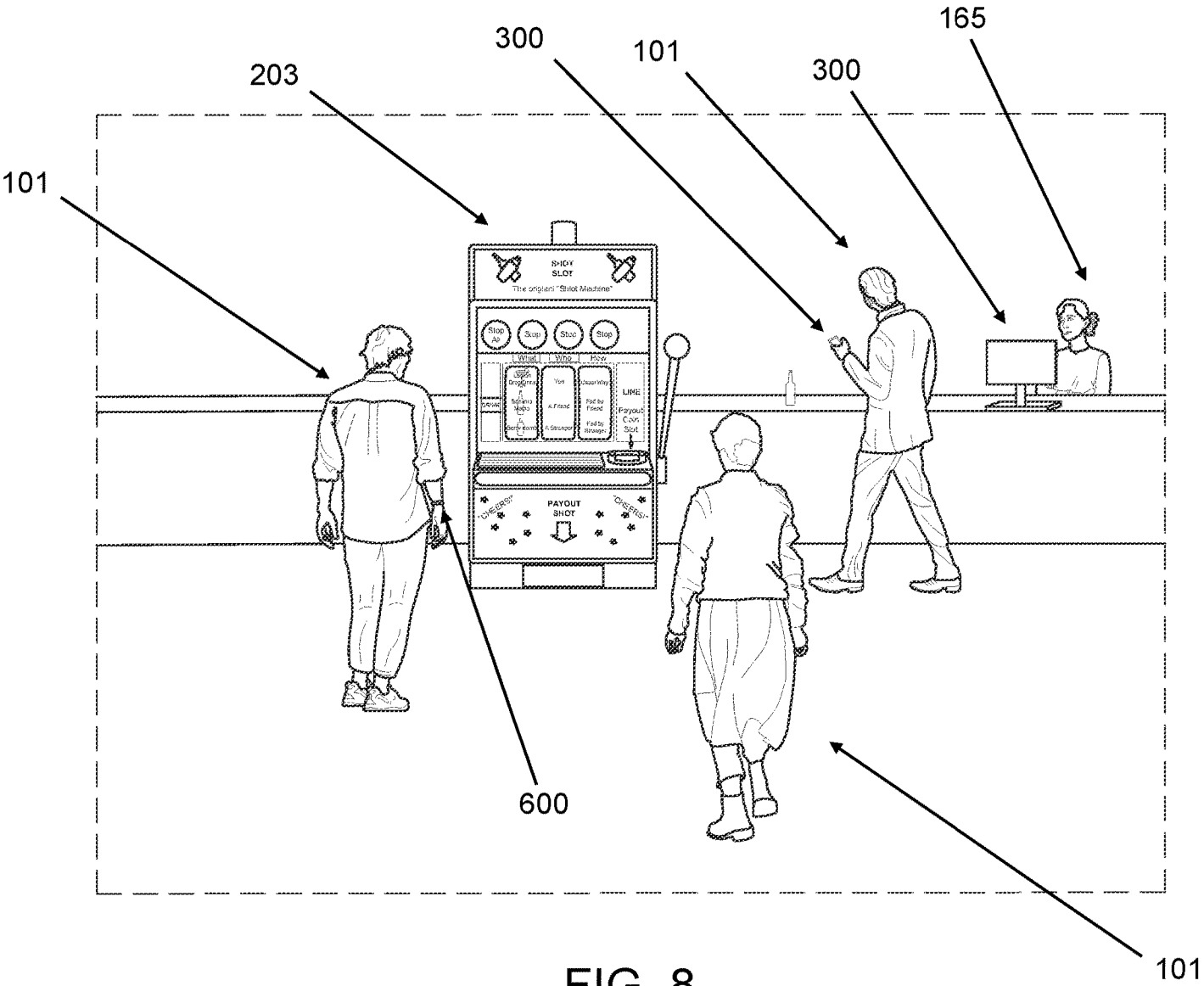
FIG. 8 is an illustration of users interacting with a drink ingredient selecting game machine.

Additionally, FIG. 7 shows selection indicators 228. In FIG. 6, the selection indicator was indicated by a word next to the selection reels. In the FIG. 7 example, selection indicator 228 are a series of lines going horizontal and diagonally. These selection indicators 228 allow for a variety of different drink selections and jackpot options whereby multiple combinations may be displayed for multiple "who", "what", and "how" selections. Additionally, these lines allow users 101 to insert more money and play multiple lines and have multiple ways to win with flexible outcomes As previously discussed, gaming machine 103 and 203 may allow users 101 to access and interact with gaming machine 103 and 203 using one or more computing devices 300 to provide increased functionality and personalization as illustrated in FIG. 8.

Users 101 may initially register to become a registered user associated with communication system 160 through drinking game application 386. In one or more non-limiting embodiments, drinking game application 386 may be innate, built into, or otherwise integrated into existing social media platforms or systems such as a website, a third party program, Apple™ operating systems (e.g. iOS), Android™, Snapchat™, Instagram™, Facebook™, or any other platform. Drinking game application 386 may be downloadable and installable on computing devices 300. In one or more non-limiting embodiments, drinking game application 386 may be preinstalled on computing devices 300 by the manufacturer or designer. Further, drinking game application 386 may be implemented using a web browser via a browser extension or plugin. Server 400 may associate computing devices 300 with an account during the registration process. The account may be user specific or specific to a home, enclosure, or other physical boundary that includes multiple users 101, and a unique identification of each computing devices 300 may be stored in the account on databases 450.

Users 101 may be requested to take pictures of themselves whereby server 400 collects and stores pictures of each user in databases 450 that may be presented to other users 101, for example, through a user interface 350. Pictures may also be received by camera 170 and 270. Pictures may be for identification purposes during navigation of a session and to enhance the authenticity of the process by ensuring that the picture is of the correct, intended user when interacting with other users 101. Users 101 may couple, link, or connect with user accounts from social networking websites and internal networks. Examples of social networking websites include but are not limited to Instagram®, Facebook®, LinkedIn®, Snapchat®, and Twitter®.

Upon successful authentication of a user though drinking game application 386, a dashboard or home page may be generated. The homepage may be modified, deleted, written to, or otherwise administered by their respective user. Display to user through user interface 350 may comprise a number of different subpages viewable or accessible through user interface 350 by selecting one or more tabs or other methods.

After registering, users 101 may invite other users 101, or be invited by other users 101, to connect via drinking game application 386. The connection may be mutual where both users 101 consent to the connection. In some embodiments, the connection may be one sided where one user "follows" the other user, which does not require the other user's approval. When one user 101 has a connection with another user, the connected users 101 may be able to communicate with the other user as well as receive the connected user's requests, messages, picture, videos, and other content.

User interface 350 on computing devices 300 may display multiple gaming machines 103 and 203 that are registered or otherwise accessible to users 101 at a location they are at or remote location whereby they may join a game session with gaming machines 103 and 203. Once users 101 have joined a game session with gaming machines 103 and 203, they may receive notifications concerning different aspects of the game session which may be transmitted from gaming machines 103 and 203 through server 400 or directly by gaming machines 103 and 203.

To view gaming machines at the specific location or establishment that user 101 is at, user 101 may "check in" to the establishment or may automatically determine the location of the user based on the GPS location of computing device 300. A "check in" as used herein is self-reported positioning of users 101 at a physical place. In some embodiments, users 101 must be at the physical location while in other non-limiting embodiments users 101 may check in to any establishment from any location. User's "check-in" may also be recorded and uploaded to databases 450 of server 400 whereby the "check-in" may be transmitted and visible to other computing devices 300 user interface 350 displays of users 101 who have "checked in" and their current status. Server 400 may also store user's "check-in" in databases 450 for subsequent use and collection of information pertaining to users 101.

User interface 350 may display information to users 101 who have joined a session of gaming machines 103 and 203. A status for each user and gaming machine 103 and 203 may be displayed on a list. In one embodiment, the list may be a dynamic list in which gaming machines 103 and 203 are ordered according to if they are joinable or the amount of users 101 who have joined a game session. When a gaming machine 103 and 203 is not connected, a status is not displayed for gaming machines 103 and 203, or in some embodiments, gaming machines 103 and 203 may be indicated as not connected.

If a game machine 103 or 203 is not currently being used by any users 101, a user such as first user 101, may initiate a game session whereby a virtual lobby is created with first user that is visible to other users 101, such as a second user. In other embodiments, user interface 350 may present to first user an optical bar code, a QR code, a RFID tag, or other suitable identification technology, which may be used to create a game session with gaming machines 103 and 203. This may be achieved using the optical bar code, a QR code, or a RFID tag of gaming machine 103.

Second users 101 may then select gaming machine 103 or 203 through user interface 350 and join the game session whereby second user 101 is now associated with gaming machine 103 or 203 for a game session and is visible in the created virtual lobby. In other embodiments second user 101 may scan an optical bar code, a QR code, a RFID tag, or other suitable identification technology in a similar manner to first user 101. First and second users 101 may also invite or challenge other users 101 to a game session. Other users 101 may be displayed on user interface 350 as a list or a drop-down menu. The list may display all user 101 who have established a mutual connection with other users 101 as well as users 101 in the same location of first user. Other users 101 may be displayed in different ways through user interface 350 that may be differentiated by numerous parameters, such as users 101 who have "joined" a game session of gaming machine 103 or 203, users 101 who are currently looking to join a game session on a gaming machine 103 or 203, and users 101 who are idle. User interface 350 may provide additional information to users 101 such as if they had initiated a game session with user 101 before and how many times they competed.

Users 101 may receive a notification that a "challenge" to a game session has been initiated by first user 101 whereby second user 101 may decide whether to accept or reject the challenge by confirmation through user interface 350. If the "challenge" is declined, the session may be terminated and first user 101 may be notified of the rejection. If the "challenge" is accepted, first user 101 and second user 101 may be connected in a game lobby associated with a gaming machine 103 or 203. User interface 350 then may present song selection menu whereby when users 101 select one or more songs the songs may be added to the song selection queue. Though users 101 competing individually during a game session is the example being explained, multiple users 101 may be on a single team whereby users 101 may be divided into teams of two or three to play other teams of two or three whereby results of all teammates are averaged or combined.

In some embodiments, user interface 350 may present a screen for first user 101 to create a code sequence such that the virtual lobby may not be accessed by other users 101 unless the code sequence is reproduced by another user 101. Other users 101 may be presented through user interface 350 a code entry field by selecting game machine 103 or first user 101, whereby other users 101 may insert a code into the appropriate field. If the correct code is entered, other users 101 may gain access to the virtual lobby and game session.

Once a predetermined amount of users 101 are in the game lobby or users 101 choose to initiate a game session, the game session may begin in a similar manner with the rules previously discussed. Server 400 may store information pertaining to the game session including information pertaining to the users 101 along with drinks chosen.

Computing devices 300 provides added interactivity with gaming machines 103 and 203 such that users 101 may play the game while navigating around an establishment so they won't be required to sit by gaming machines the entire time, as illustrated in FIG. 8. Users 101 may receive notifications transmitted from control system 150 of gaming machines 103 and 203 to communication system 160 to server 400 that are then transmitted and displayed to users 101 through user interface 350. Notifications may include a notification notifying that it is user's 101 turn to pull the lever, that the user has to consume a drink including what kind of drink and how to consume the drink, and any other events occurring within the game session. When user has to consume a drink, user interface 350 may present to user 101 a screen with a selectable button user 101 may select if they completed or failed the drink challenge. The selection is then transmitted in databases 450 of server 400 with corresponding data pertaining to users 101 and the game session.

The connection between gaming machines 103 and 203 and computing devices 300 may provide establishments with drink orders from gaming machines 103 and 203 such that the establishment may prepare the drinks in a quick and consistent manner for users 101 during a game session.

Establishments may initially register to become a registered establishment associated with game session application 386 through one or more computing devices 300, such that the establishment may be notified of drinks to be made or other events occurring with game sessions of gaming machines 103 and 203. Upon initially signing up with game session application 386, establishments may be prompted to provide information along with a requested password. Information may be the hours, directions, promotional content, contact information, corporate structure, and reservations of establishment. When registering with drinking game application 386, establishments may also be able to log into drinking game application 386 using login credentials from other social networking platforms, such as, for example, logging in with a Yelp® profile.

Communication system 160 may transmit the drink order to computing device 300 of the establishment for presentation via user interface 350 to employees such as employee 165 in order to fulfill the order, as illustrated in FIG. 8. If the establishment has multiple computing devices 300, the order may be transmitted to the multiple computing devices 300 instead of just one or transmitting the drink order to a specific computing device 300 associated with a particular establishment or area/section of the establishment that would be responsible for providing selections on that specific order, such as a specific area of a bar or restaurant. Establishment computing devices 300 may have unique identification markers to enable establishment computing device 300 to be distinguished from one another such that users 101 may know where to report to receive their drink.

In other embodiments gaming machines 103 and 203 may print out a slip with a QR code, a RFID tag, or other suitable identification technology that may be scanned by the establishment to identify which drink needs to be made by the establishment.

If gaming machines 103 or 203 are installed in establishments, restaurants, or other entities, users 101 may pay together or individually through drinking game application 386 for a drink each time they need to consume a drink, pay a total lump sum for each game session, or may pay for a time period such as an hour or a full day. User interface 350 may display to users 101 the price of drinks, the price information including subtotal, discounts, and taxes, promotional coupon and gift card entry fields, gratuity or tipping field, mode of payment, and calculated total including subtotal combined with taxes, discounts, and gratuity added. Users 101 may input their credit card information for a credit card using any credit and debit card known in the art, including, without limitation an ATM card, a VISA®, MasterCard®, Discover®, or American Express® card in a credit/debit card input field, or can alternatively use PayPal® or the like. Users 101 may submit the payment information via an appropriate button through user interface 350.

User interface 350 may provide the ability to obtain one or more images of the credit card associated with the financial transaction. Images of the credit card may be captured by camera on user computing device 300 whereby drink game application 386 may have access to the images. Images may include a front image of the credit card and back image of the credit card. Sever 400 may collect and store pictures of one or more credit cards of each user 101 in databases 450 for subsequent use. In some embodiments, images and the extracted details of the credit card may be deleted from the memory immediately or shortly after a transaction has been completed or terminated, while in further embodiments temporarily stored credit card data may be encrypted and compressed for added security and stored on databases 450 for subsequent use whereby user interface 350 may allow users 101 to select from previously used credit cards.

Once a game session is completed, server 400 may then store information pertaining to the game session including the outcome. Users 101 may be rewarded with game achievements based on mastering certain in-game facets during the game session. As used herein, "reward" refers to a graphical, audio, numerical, or other users 101 notification event that occurs in relation to play accuracy detection. A reward may be a positive indicator of accurate game play or it may be a negative indictor of inaccurate game play. Gaming machine 103 and 202 may display advertisements to the users that are transmitted over network 500 on server 400 by one or more displays on gaming machine 103 and 20. In some embodiments users may pay extra to have a version of gaming machine 103 and 203 without advertisments.

In some embodiments gaming machine 103 and 203 may be connected to a wearable device such as wearable device 600 as illustrated in FIG. 8. Wearable device 600 may be bracelet that is positioned around the wrist of a user and for transmit notifications to user. Wearable device 600 is designed to provide users 101 with a quick streamlined method to play the game on gaming machine 103 and 203. For example, wearable devices 600 may have an identifying color such as red, green, blue, and yellow whereby each color corresponds to a user or selection reel on gaming machines 103 and 203. With a corresponding color to each user or selection reel, users 101 may determine if it is their turn or if they have to drink. Wearable device 600 may be connectable to gaming machines 103 or 203, computing devices 300, or server 400. A wearable device 600 may have one or more computing devices 300. Wearable device 600 may have one or more output components as a speaker, a light emitting section such as a from an LED, or a vibration generating exterior from a vibration motor that may provide notification to users 101. Notifications may include a notification notifying that it is user's 101 turn to pull the lever, that user 101 has to consume a drink, and any other events occurring within game session.

Figure 9:
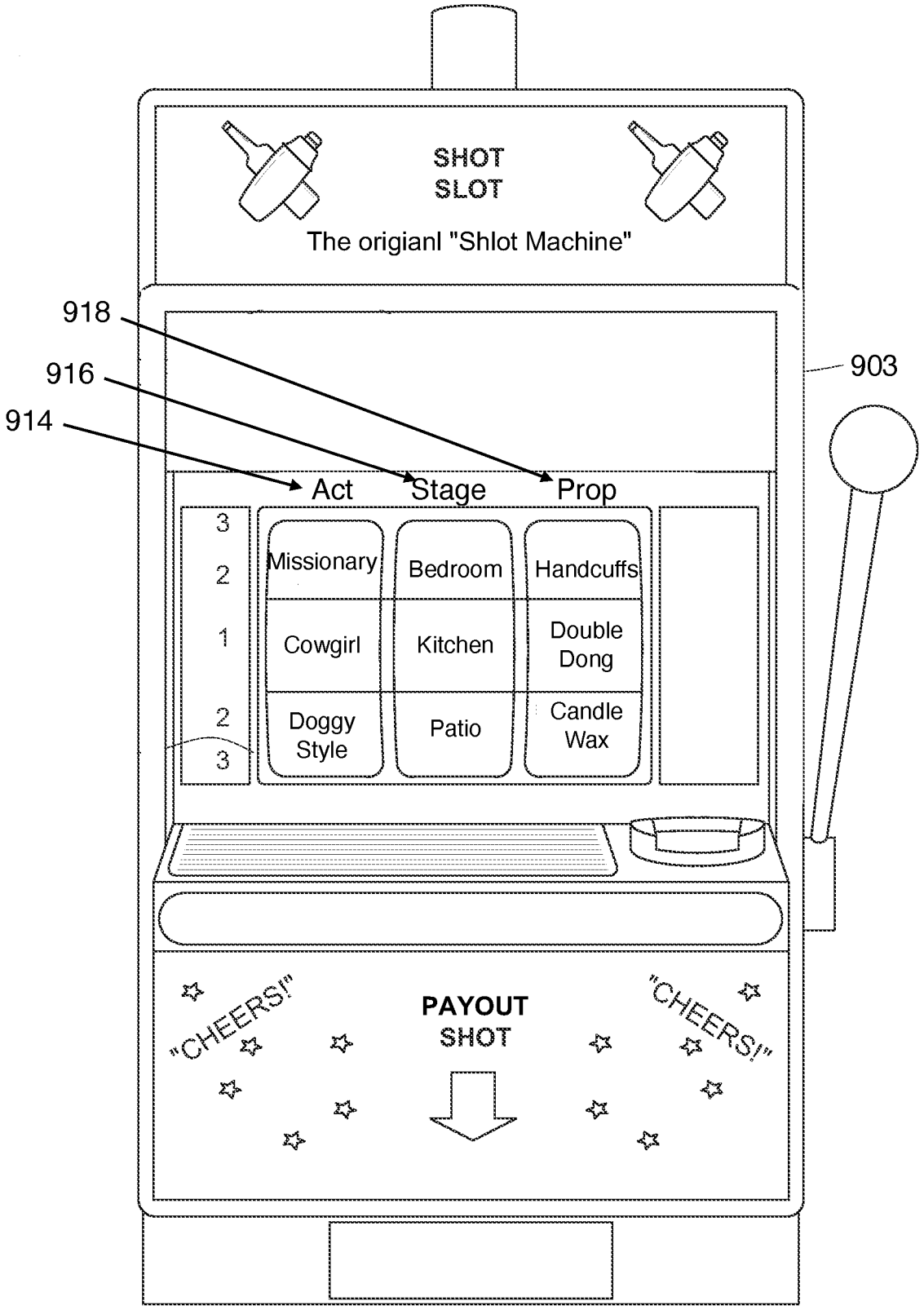
FIG. 9 is a front view of another embodiment of a game machine according to various aspects of the present disclosure.

In another embodiment, gaming machine 903, as illustrated in FIG. 9, three selection reels may be used such as a the "Act" selection reel 914, the "Prop" selection reel 916, and the "Stage" selection reel 918. In another embodiment, additional or different selections reels may be used for selection of different methods of playing the selection game. "Act" selection reel 914, as shown in the FIG. 6 embodiment, is a circular reel encoded with symbols representing different types of sexual acts around its circumference.

"Prop" selection reel 916, as shown in the FIG. 6 embodiment, is a circular reel encoded with symbols representing different types of props around its circumference. The second wheel selects which prop the players should use. "Prop" selection reel 916 has various things to spice things up like toys, whipped cream, hand ties, etc.

The third reel shown in the figure is the "Stage" selection reel 918. The third wheel selects the method where the sexual act should take place. This adds to the game aspect as it introduces an aspect of fun. Some examples the bedroom, kitchen, outside, etc.

After the reel stopping mechanism has stopped the selection reels 914, 916, and 918 from spinning, in the FIG. 9 embodiment, a the players must engage in the sexual act with a prop at a location described by the selection reels. In some embodiments gaming machine may be connected to a sex toy dispensing device in a similar way to the drink dispensing device for dispensing or otherwise producing props for the players.

The game may also start with the players agreeing on a more risqué "dare coin" (think more serious toys, or threesome for example) which is placed into the coin slot. They then spin, and must complete the act, prop and stage before they play again. They can be done together or separate as they feel. If the machine dispenses the dare coin, they must complete the dare before playing again.

In further embodiments where gaming machine 103, 203, 903, are a software application, user may "build" their wheels and dare coins. Users may be presented with a grid of images with labels that they can add to build each wheel and the dare coin such that users can delete and/or update as desired through time. User interface 350 may provide an option to choose "add to wheel" or "add to dare coin". User interface 350 then prompt users to "add your own" to any wheel or dare coin where users may then insert text for their personal idea and perhaps choose a funny icon/emoji to add. They can have as many selections as they wish. In embodiments game machine is a device application user may "build" their wheels and dare coins with prepackaged blank slates or sheets that may be positioned on rolls to change the icons as desired by the user.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A selection game comprising:

a gaming machine configured to randomly display a selection of a plurality of selections indicating which objects one or more players playing with the gaming machine will then interact with, the gaming machine comprising:

an activator; and a plurality of digital or analog selection entities having the plurality of selections wherein the activator when activated an outcome of the outcomes is indicated by at least one outcome indicator;

wherein activation of the activator, produces a specific outcome indicated by the at least one outcome indicator for the one or more players to interact with an object of the objects corresponding to the specific outcome indicated by the at least one outcome indicator.

2. The selection game of claim 1, further comprising: one or more tokens, the one or more tokens configured to be received though a payout slot on the gaming machine, the one or more tokens received if the one or more players win a jackpot wherein if the one or more players receive a certain combination of three selections in the plurality of digital or analog selection entities a row, horizontally, or in some embodiments diagonally, the one or more players wins the jackpot.

3. The selection game of claim 2, the gaming machine further comprising: one or more LED lights configured to flash periodically or emit a continuous light when there is a change in status or an event occurs during the selection game.

4. The selection game of claim 3, the gaming machine further comprising: a printer for printing redemption slips having identifying markers.

5. The selection game of claim 4, the gaming machine further comprising: an alarm, the alarm having a speaker allowing the one or more players to receive audible messages from the gaming machine.

6. The selection game of claim 4, the gaming machine further comprising: one or more cameras.

7. The selection game of claim 2, the gaming machine further comprising:

one or more databases coupled via a network;

one or more processors coupled to the one or more databases; and at least one computing device coupled to the one or more processors and the one or more databases via the network; wherein the one or more processors are configured to:

receiving, by selection game, an order over the network initiated by the gaming machine, the order created in response to the specific outcome.

8. The selection game of claim 7, wherein the one or more processors are further configured to: sending, by the selection game, a notification to the one or more players, the notification indicating one or more events occurring within the selection game.

9. The selection game of claim 1, the gaming machine connected to a dispensing device, wherein the dispensing device dispenses the object corresponding to the specific outcome.

10. The selection game of claim 1 further comprising one or more wearables, the one or more wearables configured to be notified of one or more events occurring within a selection game.

11. A selection game comprising;

a gaming machine, configured to randomly display a selection of a plurality of selections indicating which sex position one or more players playing with the gaming machine will then need to perform, where the one or more players playing with the gaming machine will perform a sexual act and what prop the one or more players playing with the gaming machine will need to use, the gaming machine comprising:

an activator; and a plurality of digital or analog selection entities having the plurality of selections wherein the activator when activated an outcome of the outcomes is indicated by at least one outcome indicator;

wherein activation of the activator, produces a specific outcome indicated by the at least one outcome indicator for the one or more players to perform the sexual act corresponding to the specific outcome indicated by the at least one outcome indicator in a location corresponding to the specific outcome indicated by the at least one outcome indicator with the prop corresponding the specific outcome indicated the at least one outcome indicator.

12. The selection game of claim 11 further comprising:

one or more databases coupled via a network;

one or more processors coupled to the one or more databases; and one or more computing devices coupled to the one or more processors and the one or more databases via the network; wherein the one or more processors are configured to:

receiving, by the selection game, an order over the network initiated by the gaming machine, the order created in response to the plurality of selections of the plurality of digital or analog selection entities indicated by he at least one outcome indicator after a stopping mechanism stops the plurality of digital or analog selection entities.

13. The selection game of claim 12, wherein the one or more processors are further configured to: sending, by the selection game, a notification to the one or more players, the notification indicating one or more events occurring within the selection game.

14. The selection game of claim 13, further comprising: one or more tokens, the one or more tokens configured to be transferred though a payout slot on the gaming machine, the one or more tokens transferred if the one or more players win a jackpot wherein if the one or more players select a certain combination of three selections in the plurality of digital or analog selection entities a row, horizontally, or in some embodiments diagonally, the one or more players wins the jackpot.

15. The selection game of claim 14, the gaming machine further comprising: one or more LED lights configured to flash periodically or emit a continuous light when there is a change in status or an event occurs during a selection game.

16. The selection game of claim 15, the gaming machine further comprising: a printer for printing redemption slips having identifying markers.

17. The selection game of claim 16, the gaming machine further comprising: an alarm, the alarm having a speaker allowing one or more players to receive an auditory signal audible messages from the gaming machine.

18. The selection game of claim 11, the gaming machine connected to a dispensing device, wherein the dispensing device dispenses the prop.

19. The selection game of claim 11, further comprising a dare coin wherein if the gaming machine dispenses the dare coin, the one or more players must complete the dare before playing again.

20. A selection game comprising:

a gaming machine configured to randomly display a selection of a plurality of selections indicating which objects one or more players playing with the gaming machine will then interact with, the gaming machine comprising:

an activator; and a plurality of digital or analog selections having the plurality of selections wherein the activator when activated causes the plurality of digital or analog selections to cycle through outcomes corresponding with a plurality of actions until an outcome of the outcomes is indicated by at least one outcome indicator when the plurality of digital or analog selections stop cycling through the outcomes;

wherein activation of the activator, produces a specific outcome indicated by the at least one outcome indicator for the one or more players to interact with an object of the objects corresponding to the specific outcome indicated by the at least one outcome indicator, the specific outcome indicating one or more beverages to be drank by the user.

* * * * *